US010513951B2

(12) United States Patent
Hegemier

(10) Patent No.: US 10,513,951 B2
(45) Date of Patent: Dec. 24, 2019

(54) FRUSTOCONICALLY SUPPORTED VALVE STEM SEAL ASSEMBLY

(71) Applicant: DANA AUTOMOTIVE SYSTEMS GROUP, LLC, Maumee, OH (US)

(72) Inventor: Timothy A. Hegemier, Avilla, IN (US)

(73) Assignee: Dana Automotive Systems Group, LLC, Maumee, OH (US)

( * ) Notice: Subject to any disclaimer, the term of this patent is extended or adjusted under 35 U.S.C. 154(b) by 0 days.

(21) Appl. No.: 16/061,793

(22) PCT Filed: Dec. 15, 2016

(86) PCT No.: PCT/US2016/066822
§ 371 (c)(1),
(2) Date: Jun. 13, 2018

(87) PCT Pub. No.: WO2017/106437
PCT Pub. Date: Jun. 22, 2017

(65) Prior Publication Data

US 2018/0371965 A1 Dec. 27, 2018

Related U.S. Application Data

(60) Provisional application No. 62/267,345, filed on Dec. 15, 2015.

(51) Int. Cl.
*F01L 3/08* (2006.01)
*F01L 1/26* (2006.01)

(52) U.S. Cl.
CPC ..... *F01L 3/08* (2013.01); *F01L 1/26* (2013.01); *F01L 3/085* (2013.01)

(58) Field of Classification Search
CPC ..... F01L 3/08; F01L 3/085; F01L 1/26
See application file for complete search history.

(56) References Cited

U.S. PATENT DOCUMENTS

| | | | |
|---|---|---|---|
| 2,497,008 | A | 2/1950 | Melidoni |
| 5,553,869 | A | 9/1996 | Stamback |
| 5,558,056 | A | 9/1996 | Sakata |

(Continued)

FOREIGN PATENT DOCUMENTS

| | | |
|---|---|---|
| EP | 0750097 | 12/1996 |
| GB | 1078586 | 8/1967 |

OTHER PUBLICATIONS

European Patent Office, International Search Report with Written Opinion issued in PCT/US2016/066822 dated Mar. 22, 2017, 10 pages, European Patent Office, Rijswijk, Netherlands.

*Primary Examiner* — Jacob M Amick
(74) *Attorney, Agent, or Firm* — Marshall & Melhorn, LLC

(57) ABSTRACT

A valve stem seal assembly has an elastomeric seal with first and second radially inwardly directed sealing lips that are in intimate sealing contact with a valve stem. The assembly also has a metal seal retainer with a first metal seal retainer portion that has a surface axially slanted inward and downward from a top of the elastomeric seal. This slanted portion forms a metal frustoconical foundation with a second metal seal retainer portion that directly radially extends from the metal frustoconical foundation. The axially slanted inward surface of the metal retainer is directly radially outward from the radially inwardly directed first sealing lip.

12 Claims, 2 Drawing Sheets

(56) References Cited

U.S. PATENT DOCUMENTS

| | | | | |
|---|---|---|---|---|
| 6,244,235 | B1 * | 6/2001 | Hegemier | F01L 1/26<br>123/188.6 |
| 6,450,143 | B1 | 9/2002 | Hegemier | |
| 6,516,769 | B2 | 2/2003 | McArthy | |
| 7,654,537 | B2 | 2/2010 | Scarano | |
| 7,862,048 | B2 | 1/2011 | Scarano | |
| 8,714,563 | B2 | 5/2014 | Yamamoto | |
| 9,052,018 | B2 | 6/2015 | Hegemier | |
| 2014/0077459 | A1 * | 3/2014 | Hamaya | F01L 3/08<br>277/549 |

* cited by examiner

FRUSTOCONICALLY SUPPORTED VALVE STEM SEAL ASSEMBLY

FIELD

An engine valve stem seal assembly is disclosed. More particularly, a frustoconically supported engine valve stem seal assembly is disclosed.

BACKGROUND

For an engine, a valve stem seal assembly cooperates with an engine valve stem to provide lubrication and to contain engine gases within engine inlet and exhaust ports. To accomplish these functions, such a valve stem seal assembly typically includes an elastomeric seal that provides an elastomeric-to-metal seal between the engine elastomeric seal and the engine valve stem.

FIG. 1 illustrates a prior art valve stem seal assembly, which is disclosed in U.S. Pat. No. 6,450,143, having a one-piece cylindrical-shaped foundation seal retainer 128 for supporting a valve stem seal 126. The retainer 128 includes a lower portion 130 and an upper portion 134. The lower portion 130 is separated from the upper portion 134 by a transition area 136. The transition area 136 serves to reduce the inner diameter of the retainer 128 between a lower diameter D1 and an upper diameter D3. The transition area 136 is formed as an inwardly extending radial ledge located on the valve guide 22 where the diameter of the valve guide 22 is reduced from a first diameter 137 to a smaller, second diameter 139.

An inner surface 138 of the transition area 136 engages an upper surface 140 of the first diameter 137 of the valve guide 22. The valve stem seal 126 engages the outer circumference 54 of the valve stem 20 to provide a seal. An outer circumference 158 of the seal 126 is supported by and engages an inner circumference of the upper retainer portion 134. The valve stem seal 126 includes an upper seal 160 and a lower seal 162. The upper seal 160 includes an inner surface 145 that engages an upper surface 147 of the second diameter 139 of the valve guide 22. The retainer lower portion 130 has a valve spring 24 disposed therearound. The valve spring 24 rests on and cooperates with an integral flange 43 to maintain the seal 126 in position on the valve guide 22. Under high pressure conditions, the valve spring 24 tends to prevent the guide 22 from being lifted, which can result in seal failure due to bursting.

Unfortunately, the cylindrical-shaped foundation retainer 128 of the '143 patent has a limited effect in an axial direction by allowing the elastomeric seal 126 to partially axially extrude from the bottom to the top of the seal 126 when pressure is applied under the elastomeric seal 126. Such cylindrical-shaped foundation seal support assemblies only partially solve the problem of leakage in the axial direction into which the elastomeric seal 126 partially extrudes. Consequently, the cylindrical-shaped foundation arrangement has limited strength in the axial direction by allowing the elastomeric seal 126 to shear and partially extrude when pressure is applied under the elastomeric seal 126.

Therefore, what is sought is a valve stem seal assembly whose elastomeric seal does not extrude, thereby providing a low oil metering rate performance and better containment of engine gases in the axial direction, than existing one-piece cylindrical-shaped foundation valve stem seal assemblies.

SUMMARY

A valve stem seal assembly has an elastomeric seal with first and second radially inwardly directed sealing lips that are in intimate sealing contact with a valve stem. The valve stem seal assembly also has a metal seal retainer having a first metal seal retainer portion with a surface slanted axially downwardly and slanted radially inwardly from a top of the elastomeric seal. The downward and inward slanted first metal seal retainer portion forms a metal frustoconical foundation unitarily with a second metal seal retainer portion that directly radially extends therefrom. The axially slanted inward surface of the metal retainer is radially outward from the radially inwardly directed first sealing lip of the elastomeric seal.

Further objects and advantages of the present invention will be apparent from the following description and appended claims, reference being made to the accompanying drawings forming a part of a specification, wherein like reference characters designate corresponding parts of several views.

DESCRIPTION OF THE INVENTION

It is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions, directions or other physical characteristics relating to the embodiments disclosed are not to be considered as limiting, unless the claims expressly state otherwise.

Figure 2:
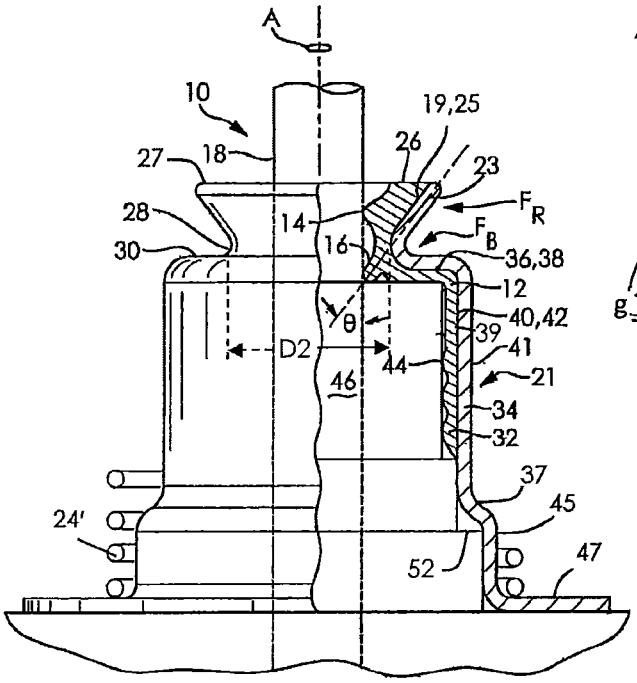
FIG. 2 is a side cross-sectional plan view of a first valve stem seal assembly having a metal seal retainer with a metal frustoconical foundation.
Figure 2A:
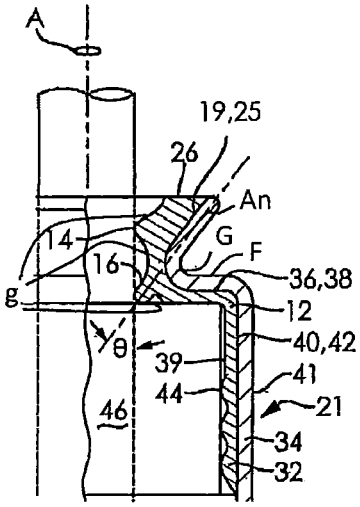
FIG. 2A is an inset of the side cross-sectional plan view of the first valve stem seal assembly having the metal seal retainer with the metal frustoconical foundation of FIG. 2.

FIG. 2 depicts a first valve stem seal assembly 10 that has an elastomeric seal 12 with upper and lower radially inwardly directed sealing lips 14, 16, which are in intimate sealing contact with a valve stem 18. The upper sealing lip 14 is known as an oil lip and the lower sealing lip 16 is known as a gas lip. The upper lip 14 is primarily used for maintaining lubrication on the valve stem while blocking excess lubrication and debris from entering an engine port (not shown but well known in the art). As FIG. 2A illustrates, there are three gaps g, where one is above the upper sealing lip 14, one is between the upper sealing lip 14 and the lower sealing lip 16, and there is one below the lower sealing lip 16.

The lower lip 16 is primarily used to prevent gases, within the port, from escaping therefrom. A first side of the lower lip 16 is by the valve stem 18 and a second side of the lower lip 16 is by the retainer 21. The lower lip 16 is more flexible than the upper lip 14 so as to allow a small amount of lubrication to coat the valve stem 18 on a down stroke (i.e., while entering the engine port) but when the valve stem 18 is on an up stroke (i.e., while leaving the engine port) the gases are sealed off from leaving the engine port. The upper lip 14 is rounded and axially supported by a metal retainer 21. A first side of the upper lip 14 is by the valve stem 18 and a second side of the upper lip 14 is by the retainer 21. Both lips 14, 16 continually extend circumferentially.

Further, the lower lip 16 is axially supported by a metal (e.g., steel) frustoconical retainer foundation 28, wherein the elastomeric seal 12 has an axially inwardly slanted surface 19 that is angled (see An in FIG. 2A) inward starting from outer upper edge of the retainer to an inner groove (see G in FIG. 2A) of the retainer 21, and then extends through a flat area (see F in FIG. 2A) that is radially away from the inner groove. The axially inwardly slanted surface 19 extends continuously circumferentially about the retainer 21. As seen in both FIGS. 2 and 2A, the seal 12 and retainer portions 23, 30, by way of their respective surfaces 19/25 and 36/38 conform to the foundation 28 and its particular parts An, G, and F.

Figure 1:
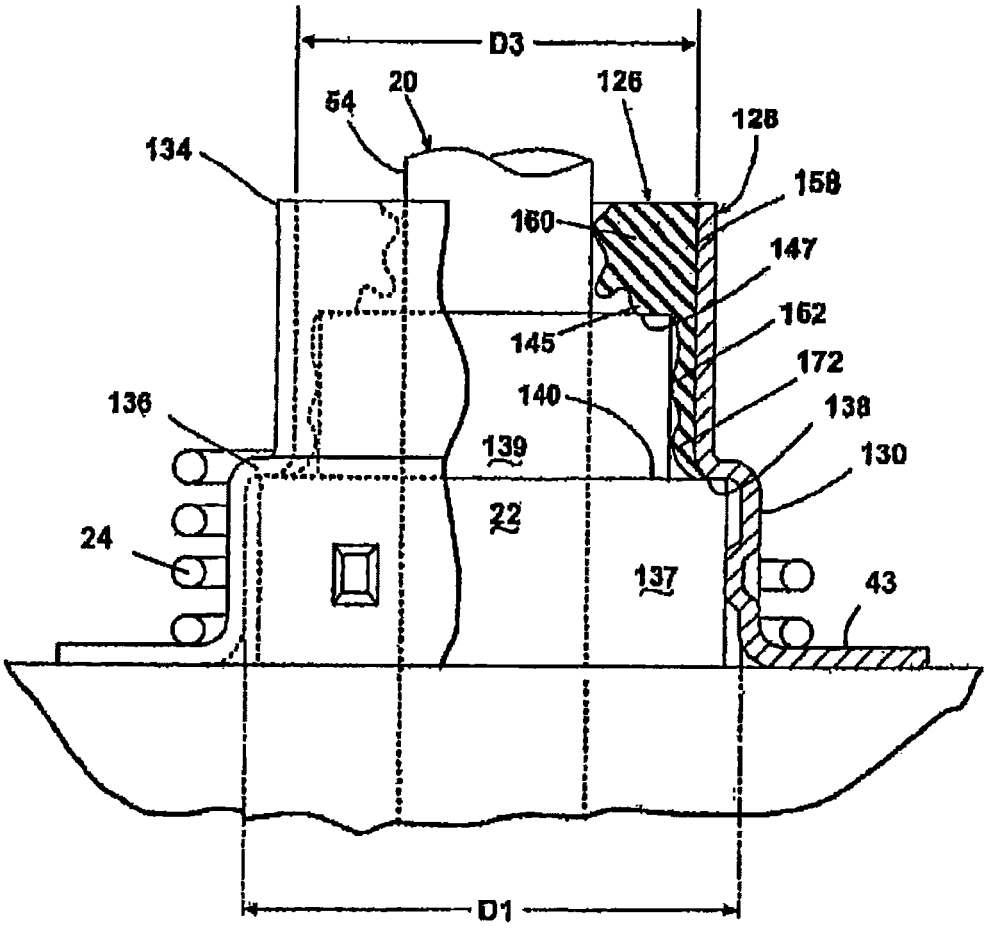
FIG. 1 Prior Art
FIG. 1 is a side cross-sectional plan view of a prior art valve stem seal assembly with a retainer having a cylindrical-shaped foundation.

The advantage of the inventive frustoconical foundation 28 is that this metal foundation 28 (see diameter D2 in FIG. 2) is brought in much closer to the valve stem 18, than conventional foundations, like foundation 128 (see diameter D3 in FIG. 1) in FIG. 1, of U.S. Pat. No. 6,450,143. Thereby, the frustoconical foundation 28 isolates the upper portion of the elastomer seal 12 that is above the lips 14, 16 from the lower portion of the elastomeric seal 12 that is below the lips 14, 16, at the points of contact with the valve stem 18. As seen in both FIGS. 2 and 2A, the seal 12 and retainer portions 23, 30, by way of their respective surfaces 19/25 and 36/38 conform to the foundation 28 and its particular parts An, G, and F.

Further, the first valve stem seal assembly 10 has the metal seal retainer 21 with a first metal seal retainer portion 23 that has an inward surface 25 that is axially slanted inwardly from a top 26 of the elastomeric seal 12. The top 27 of the retainer 21 is typically flush with the top 26 of the seal 12. The first metal seal retainer portion 23 is downwardly slanted to unitarily form the metal frustoconical foundation 28 with a second metal seal retainer portion 30 that radially extends therefrom, thereby forming its groove shape as viewed in FIG. 2.

Throughout the groove shaped inward retainer portion 23, 30 of the first valve stem seal assembly 10, the seal/retainer surfaces 19, 25 and 36, 38 respectively stay in intimate sealing contact with each other, while the seal/retainer surfaces 19, 25 and 36, 38 remain coplanar with each other. Also, a lower seal portion 39 and a first lower vertical retainer portion 41 have intimate respective sealing surfaces 40, 42. Further, although not a necessary feature seal the valve guide 46, to the lower seal portion 39 has ribs 44 that make intimate sealing contact with a valve guide 46, which has a valve spring 24' therearound.

Specifically, the slanted surface 25 of the metal retainer 21 is radially outward from the inwardly directed first sealing lip 14 of the elastomeric seal 12. The first metal seal retainer portion 23 and the second inwardly directed sealing lip 16 of the elastomeric seal 12 are substantially directed inwardly at an angle θ (for example, 35°), from the axis A of the valve stem 18. Also, a lower portion 32 of the elastomeric seal 12 is in sealing contact and is coplanar with a lower portion 34 of the metal seal retainer 21.

Consequently, by way of its flat (F), groove (G), and angled (An) structure, the metal frustoconical foundation 28 blocks axial stress exerted on the seal 12 from gas pressure in the engine port. Thereby, the axial stress is kept from axially forcing the seal 12 to move axially straight up and inline along the inside surfaces 25, 38, 42 of the retainer 21. Thereby, preventing the seal 12 from extruding axially upward as conventional seals like that of the '143 patent. Additionally, the frustoconical foundation 28 improves the ability of the second sealing lip 16 to contain engine gasses, over that of conventional foundations like that of the '143 patent, because when the seal 126 is extruded by engine gasses, then its lips 145, 160 become distorted and oil and gasses are not contained properly.

Hence, in contrast to the vertically straight prior art retainer 128, at its upper portion 134, the elastomeric seal surface 19 and the retainer surface 25 of the instant invention are in direct contact with each other while both are inwardly directed. Consequently, due to the frustoconical shape of the foundation 28, a resistive force FR is applied to the first radially inwardly directed sealing lip 14 and a back support force FB is applied to the second radially inwardly directed sealing lip 16. These additional forces FR, FB are a result of the above-described structure of the present invention that does not exist in the prior art seal assembly of FIG. 1.

Hence, as a result of the structure of the first and second valve stem seal assembly 10, any excess oil and debris that would be inclined to pass between the first sealing lip 14 and the valve stem 18 is more inclined to be blocked by the metal frustoconical foundation 28. Also, any gas under pressure that might be inclined to pass between the second sealing lip 16 and the valve stem 18 is also more inclined to be blocked by the second sealing lip 16 in conjunction with the metal frustoconical foundation 28. Thereby, the metal frustoconical foundation 28 results in a much lower oil metering rate or even an elimination of an oil metering rate. This is accompanied by significantly better containment of engine gases in the axial direction, than existing valve stem seal assemblies, as that of the '143 patent, without experiencing an extrusion of the elastomeric seal 12.

At the second metal seal retainer portion 30, the inward surface 36 of the retainer portion 30 and the outward surface 38 of the elastomeric seal 12 are in direct axial contact with each other. Furthermore, these surfaces 36, 38 of the first valve stem seal assembly 10 help to block any further gas under pressure that might be inclined to pass between the second sealing lip 16 and the stem 18, which is not blocked by prior art retainers having a cylindrical-shaped foundation in the area of the sealing lips 14, 16, like that of the '143 patent.

In the first valve stem seal assembly 10, the first lower radial retainer portion 41 is radial until it is adjoined to a radially bending outward portion 37 that in turn is adjoined to a second lower radial retainer portion 45, which is then adjoined to an axial spring seat flange 47. These lowest portions 37, 45, and 46 of the first lower vertical retainer portion 41 are unitarily and integrally formed therewith.

Figure 3:
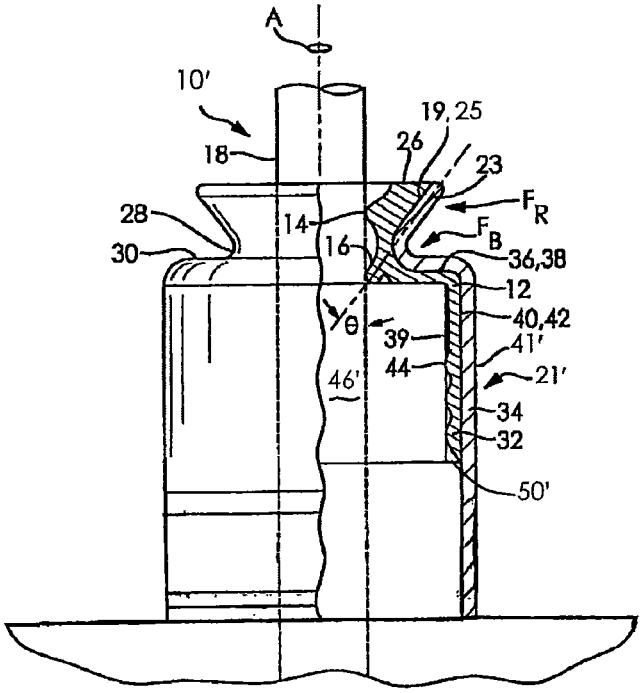
FIG. 3 is a side cross-sectional plan view of a second valve stem seal assembly having a metal seal retainer with a metal frustoconical foundation.

It is much more common to have a valve guide step 50 machined in a valve guide 46 that extends outward a bit further under the lowest extent of the seal 12, as the first valve stem seal assembly 10 is structured. However, a second valve stem seal assembly 10' is provide, as illustrated in FIG. 3, where the second valve stem seal assembly 10' has a less extended valve guide step 50' that can be utilized where there is limited space available at the lower portion thereof. Also in this embodiment 10', the three lowest axial elements 37, 45, and 47 of the retainer 21 illustrated in FIG. 2, are merely replaced by a lower vertical retainer portion 41' that cylindrically extends to the bottom of the second valve stem seal assembly 10'. Consequently, the second valve stem seal assembly 10' can be applied to an engine arrangement (not shown) that does not have the lateral space available for the three lowest retainer elements 37, 45, 47 and the valve spring 24' of the first valve stem seal assembly 10. This extended lower vertical retainer portion 41' allows for an engine application of the valve stem seal assembly 10' having all of the above-stated benefits associated with the inventive metal frustoconical foundation 28.

In accordance with the provisions of the patent statutes, the principles and modes of operation of this invention have been described and illustrated in its preferred embodiments. However, it must be understood that the invention may be practiced otherwise than specifically explained and illustrated without departing from its spirit or scope.

What is claimed is:

1. A valve stem seal assembly, comprises:

an elastomeric seal having first and second radially inwardly directed sealing lips in intimate sealing contact with a valve stem; and a metal seal retainer having a first metal seal retainer portion with a surface axially slanted inward and downward from a top of the elastomeric seal to form a metal frustoconical foundation with a second metal seal retainer portion radially extending therefrom;

wherein the axially slanted inward surface of the metal retainer is radially outward from the radially inwardly directed first sealing lip of the elastomeric seal.

2. The valve stem seal assembly, of claim 1, wherein the elastomeric seal has an axially inwardly slanted surface that is angled inward starting from an outer upper edge of the retainer to an inner groove G of the retainer, and then extends through a flat F area radially from the inner groove; and wherein the axially inwardly slanted surface extends continuously circumferentially about the retainer, so that the frustoconical foundation isolates an upper portion of the elastomer seal that is above the lips from the lower portion of the elastomeric seal that is below the lips.

3. The valve stem seal assembly of claim 2, wherein the metal seal retainer with said first metal seal retainer portion has an inward surface that is axially slanted inwardly from a top of the elastomeric seal; and wherein the top of the retainer is flush with the top of the seal and the first metal seal retainer portion is downwardly slanted to unitarily form the metal frustoconical foundation with said second metal seal retainer portion that radially extends therefrom, so as to form the groove shape.

4. The valve stem seal assembly of claim 3, wherein throughout the groove shaped inward retainer portion the seal/retainer surfaces stay in intimate sealing contact with each other, while the seal/retainer surfaces remain coplanar with each other.

5. The valve stem seal assembly of claim 4, wherein the slanted surface of the metal retainer is radially outward from the inwardly directed first sealing lip of the elastomeric seal, the first metal seal retainer portion and the second inwardly directed sealing lip of the elastomeric seal are substantially directed inwardly at an angle θ from an axis A of the valve stem; and wherein a lower portion of the elastomeric seal is in sealing contact and is coplanar with a lower portion of the metal seal retainer and that the metal frustoconical foundation blocks axial stress exerted on the seal from gas pressure in the engine port, so that the axial stress is kept from axially forcing the seal to move axially straight up and inline along the inside surfaces of the retainer, that the seal is prevented from extruding axially upward, and that the frustoconical foundation contains engine gasses of the second sealing lip.

6. The valve stem seal assembly of claim 5, wherein the elastomeric seal surface and the retainer surface are in direct contact with each other while both are inwardly directed, so that the frustoconical shape of the foundation applies a resistive force FR to the first radially inwardly directed sealing lip and applies a back support force FB to the second radially inwardly directed sealing lip.

7. The valve stem seal assembly of claim 6, wherein a passing of excess oil and debris between the first sealing lip and the valve stem are blocked by the metal frustoconical foundation; and wherein a passing of gas under pressure between the second sealing lip and the valve stem is blocked by the second sealing lip in conjunction with the metal frustoconical foundation, so that oil metering rate is eliminated along with containment of engine gases in the axial direction by the metal frustoconical foundation without an extrusion of the elastomeric seal.

8. The valve stem seal assembly of claim 7, wherein, at the second metal seal retainer portion, the inward surface of the retainer portion and the outward surface of the elastomeric seal are in direct axial contact with each other; and wherein the surfaces of the first valve stem seal assembly block a passing of the gas under pressure between the second sealing lip and the stem.

9. The valve stem seal assembly of claim 8, wherein the first lower radial retainer portion is radially adjoined to a radially bending outward portion that is then adjoined to a second lower radial retainer portion that is further adjoined to an axial spring seat flange; and wherein a lower seal portion and the first lower vertical retainer portion have intimate respective sealing surfaces, so that the lower seal portion has ribs that make intimate sealing contact with a valve guide that has a valve spring therearound.

10. The valve stem seal assembly of claim 8, further comprising a valve guide having a valve guide step and a lower vertical retainer portion that cylindrically extends to the bottom of a second valve stem seal assembly, so as to be applied to an engine arrangement with limited lateral space available.

11. The valve stem seal assembly of claim 8, wherein the frustoconical retainer foundation comprises steel.

12. The valve stem seal assembly of claim 8, wherein the angle θ is 35°.

* * * * *